US005201643A

United States Patent [19]

Hirosawa et al.

[11] Patent Number: 5,201,643

[45] Date of Patent: Apr. 13, 1993

[54] COMPRESSION MACHINE

[75] Inventors: Koichiro Hirosawa; Hiroshi Kubo, both of Kariya, Japan

[73] Assignee: Aisin Seiki Kabushiki Kaisha, Kariya, Japan

[21] Appl. No.: 677,323

[22] Filed: Mar. 29, 1991

[30] Foreign Application Priority Data

Mar. 31, 1990 [JP] Japan ..... 2-35015

[51] Int. Cl.[5] ..... F04B 43/00; F04B 21/02

[52] U.S. Cl. ..... 417/472; 417/566; 417/571; 417/395

[58] Field of Search ..... 417/383-388, 417/395, 413, 571, 472, 566

[56] References Cited

U.S. PATENT DOCUMENTS

| | | | |
|---|---|---|---|
| 756,529 | 4/1904 | Rose | 417/571 |
| 862,867 | 8/1907 | Eggleston | 417/395 |
| 947,536 | 1/1910 | Wenkel | 417/571 |
| 1,719,572 | 7/1929 | Stoll | 417/571 |
| 2,463,766 | 3/1949 | Hadley | 417/566 |
| 2,654,324 | 10/1953 | Ryba | 417/413 |
| 2,669,937 | 2/1954 | Presentey | 417/413 |
| 2,814,253 | 11/1957 | Pleuger | 417/388 |
| 2,856,857 | 10/1958 | Saalfrank | 417/385 |
| 2,953,096 | 9/1960 | Sampietro | 417/383 |
| 2,960,936 | 11/1960 | Dean | 417/395 |
| 3,181,779 | 5/1965 | Rhodes | 417/571 |
| 3,314,600 | 4/1967 | Hadley | 417/571 |
| 3,319,879 | 5/1967 | Brown | 417/566 |
| 3,400,885 | 9/1968 | Enemark | 417/571 |
| 3,476,053 | 11/1969 | Czarnecki | 417/386 |
| 4,065,237 | 12/1977 | Webb | 417/571 |
| 4,110,058 | 8/1978 | Langle | 417/395 |
| 4,199,535 | 4/1980 | Kuhlen | 417/395 |
| 4,368,755 | 1/1983 | King | 417/566 |
| 4,372,208 | 2/1983 | Legardinier | 417/395 |

FOREIGN PATENT DOCUMENTS

| | | | |
|---|---|---|---|
| 471050 | 1/1951 | Canada | 417/571 |
| 523798 | of 1939 | United Kingdom | 417/571 |

*Primary Examiner*—Ricahard A. Bertsch
*Assistant Examiner*—Peter Korytnyk
*Attorney, Agent, or Firm*—Oblon, Spivak, McClelland, Maier & Neustadt

[57] ABSTRACT

In a high volumetric efficiency compression machine that can be used as a compressor, pump, or actuator, a compression chamber is formed by a movable body and the inner wall of a casing. A discharge valve is formed in the casing, and communicates with the compression chamber. Two intake valves are formed in the casing, communicate with the compression chamber and are arranged symmetrically with respect to the axial direction of the discharge valve. A rod transmits reciprocation to the movable body.

4 Claims, 1 Drawing Sheet

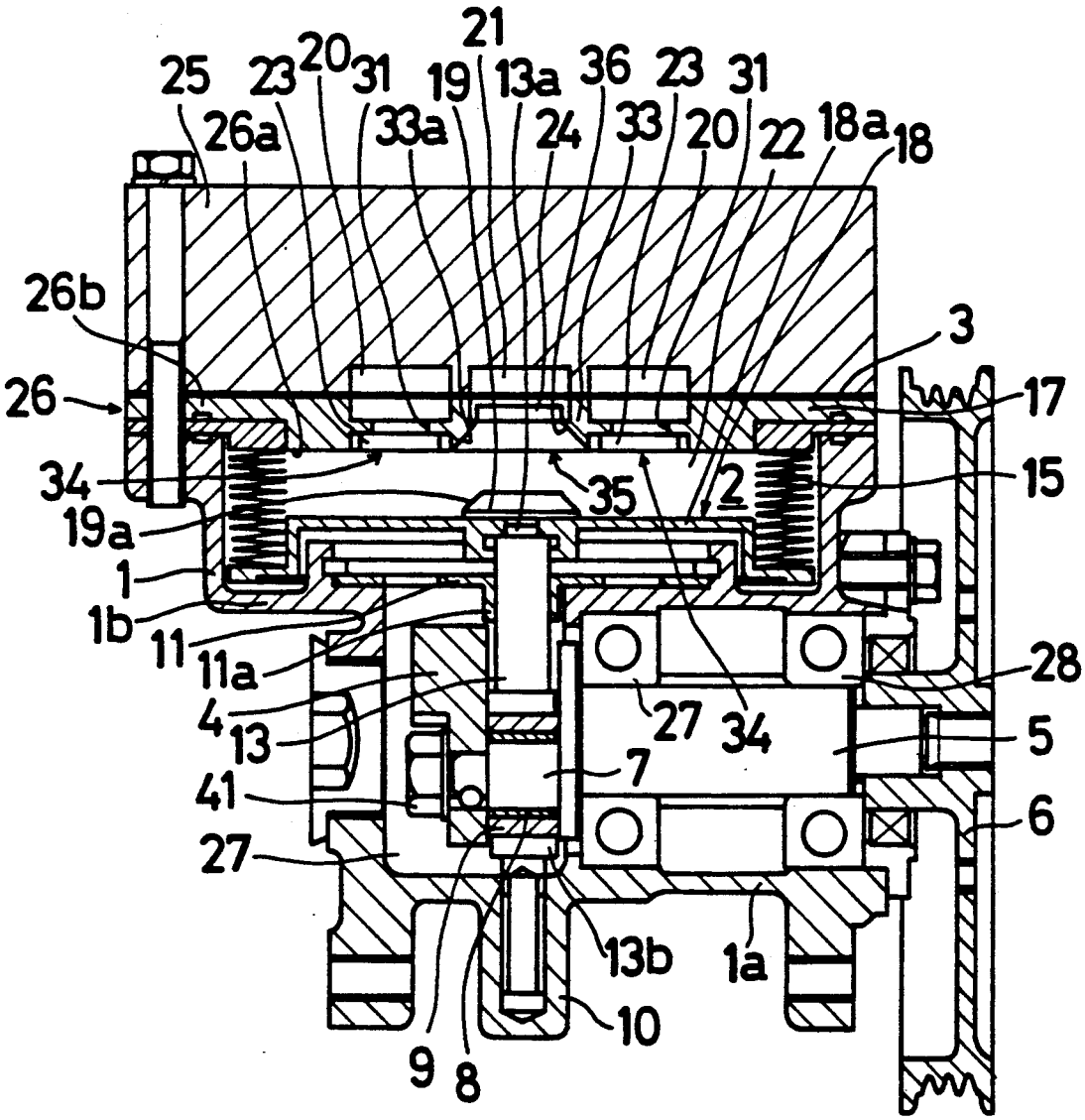
21
25
23
20
31
19
13a
36
23
31
26a
33a
24
33
20
22
18a
18
26b
3
26
17
34
35
2
15
19a
1
1b
11
11a
28
4
13
27
34
5
41
7
6
27
13b
1a
10
9
8

COMPRESSION MACHINE

BACKGROUND OF THE INVENTION

1. Field of the Invention

The present invention relates to a machine which compresses or conveys fluid and can be used as a compressor, pump, or actuator.

2. Discussion of the Related Art

A known machine compresses or conveys fluid by making use of changes in the volume of a compression chamber formed by a moving means and the inner wall of a casing, the changes being brought about by movement of a movable body. The movable body consists of a diaphragm in the casing. A diaphragm type pump in which a diaphragm is used as the movable body is disclosed in Japanese Patent Laid Open No. 246569/1988.

The flow resistance at the intake side in the compression machine significantly reduces the volumetric efficiency of the compressor even if the resistance has a low value, so that the flow resistance has a great influence on the performance of the compression machine.

To reduce the flow resistance, it has been known to enlarge the area of the flow passageway, but this results in an intake valve of a large size and the operation characteristics of the compressor are degraded at high rotation speeds due to valve inertia. Moreover, the conventional compression machine may be of cylindrical form and cannot accept a large valve, and the enlargement of the flow passageway is wasteful.

Thus, in the diaphragm pump disclosure in the abovementioned publication, the intake resistance at the valve portion is high and the volumetric efficiency is poor.

SUMMARY OF THE INVENTION

It is an object of the invention to provide a novel compression machine which is free of the foregoing problems.

The above object is achieved by a compression machine comprising a movable body accommodated in a casing, a rod which transmits the reciprocation thereof to the movable body a compression chamber formed by the movable body and inner wall of the casing, a compression means which reciprocates the movable body by a driving means to compress the fluid inside the compression chamber and to force the fluid out of the chamber according to changes in the volume of the chamber, and two intake valves which are mounted symmetrically with respect to a discharge valve which is arranged in the center in the case forming the chamber.

Preferably, the discharge valve is communicated with a discharge port, is formed in the inner wall of the case, and is provided with a recess engaged with the head of the rod.

The compression machine as described above can accomplish the enlargement of the passageway's area without enlargement of the valves; that is, it can decrease flow resistance without hampering characteristics at high speed operation of the valve.

Moreover, the force exerted on the movable body is well balanced, and there is no offset of intake flow and discharge flow by the arrangement of the intake valve and the discharge valve.

BRIEF DESCRIPTION OF THE DRAWINGS

The single FIGURE is a vertical cross section of a compression machine according to the present invention.

DETAILED DESCRIPTION OF THE PREFERRED EMBODIMENT

Referring to FIGURE, there is shown a bellows type compression machine according to the invention.

This machine includes a case, generally indicated by reference numeral 1. The case 1 and a valve case 26 constitute or form a casing 2. A movable body in the form of a bellows 15 is accommodated in the casing 2. The bellows 15 has one end mounted to a support 17 which is ring shaped and another end mounted to a support 18 which is disk shaped. The bellows and support form a movable body. A compression chamber 22 is formed by the support 18 and a valve case inner wall **26*a***.

The support 17 is fixed between a step portion **26*b* of the valve case 26 and the case 1, and the support 18 is fixed to nose portion 13*a* of a rod 13 by the nut 19 which has a conic surface 19*a*. The bellows 15 expands or contracts according to the upwards or downwards movement of the rod 13, so that volume of the chamber 22** is varied.

An upper case 25 is attached via a gasket 3 to an upper surface of the valve case 26 so as to be on the opposite side of the chamber 22.

The rod 13 is provided at its central portion with a substantially oblong slot **13*b* which is elongate in a direction transverse to the length of the rod 13. An annular roller 9 slides in the slot 13*b*. A shaft 7 fits in the roller 9 via a bearing 8 and is eccentrically mounted to an input shaft 5. When the input shaft 5 turns, the axis of the shaft 7 rotates around the central axis of the input shaft 5. A counterweight 4 is fixed to the shaft 7 by the nut 41 to maintain stable rotation of the shaft 7 in spite of the unbalanced centrifugal force arising from the rotation of the shaft 7**.

The case 1 has a step portion **1*b* on which the support 11 is mounted. The rod 13 is slidably supported by the boss 11*a* of the support 11 and the wall defining a hole 10 formed in the case 1 such that rod 13** can slide up and down as viewed in the FIGURE.

The input shaft 5 is held by the boss **1*a* of the case 1 via bearings 27 and 28. A pulley 6 is fixed to the rear end of the input shaft 5 so as to lock the pulley 6** against rotary movement relative to the input shaft.

The valve case 26 includes a discharge valve 35, and two intake valves 34 arranged symmetrically with respect to the axial direction of the discharge valve 35, e.g., aligned in a single plane as shown in the FIGURE. The discharge valve has the same sectional area as of the two intake valves.

In the discharge valve 35, a discharge port 21 is formed in both valve case 26 and upper case 25. A recessed portion 33 is formed in the inner wall **26*a* of the valve case 26 and communicates with the discharge port 21 via an aperture 36, and a reed valve element 24 opens or shuts the aperture 36. The recessed portion 33 has a conical inner surface 33*a* which is of the same inclination as is the nut 19*a***.

Each intake valve 34 includes an intake port 20 formed in both the Valve case 26 and upper case 25, an aperture 31 communicating the intake port 20 and chamber 22, and a reed valve 23 element for opening and shutting the aperture 31.

The aperture 36 of the discharge valve 35 is in alignment with the rod 13, and when the rod 13 reaches its upper limit, the surfaces 33*a* and 19*a* are brought into engagement, and the nut 19*a* becomes fully accommodated within the recessed portion 33.

In the operation of the compression machine constructed as described thus far, the power transmitted to the pulley 6 from a driving machine (not shown) rotates the input shaft 5, thereby rotating the shaft 7 around the axis of the input shaft 5. This causes the roller 9 to move upward and downward while sliding horizontally in the slot 13*b*.

The vertical movement of the roller 9 drives the rod 13 upward or downward. The movement of the rod 13 is transmitted via the supports 17 and 18 to the bellows 15, which is moved upwardly or downwardly. Then, the volume of the chamber 22 is varied to repeatedly suck and discharge fluid through the ports.

During the suction stroke, downward movement of the bellows 15 increases the volume of the chamber 22 to open the reed valve 23 in the intake port 20, thus permitting the fluid to flow into the chamber 22. Because the suction fluid flows through two apertures 31 which are arranged symmetrically with respect to, and at both sides of, the discharge valve 35, the flow resistance is decreased. As a result of this, the volumetric efficiency of the compression machine improves, and the force exerted on the support 18 is balanced.

During the discharge stroke, the upward movement of the bellows 15 reduces the volume of the chamber 22. The fluid in the chamber 22 opens the reed valve 24 and flows out through the discharge port 21. During this process, the reed valves 23 are kept closed.

At the upper limit point of the rod 13, the nut 19*a* engages with the recessed portion 33. The clearance then formed between inner wall surface 26*a* of the valve case and the support plane 18*a* is minimized, so that effective compression and discharge are accomplished.

As described thus far, in a novel compression machine, the intake valve itself is not enlarged, but the aperture area (the valve area) opened and closed by the two intake valves 34, 35 increases, and by this the flow resistance decreases. As the result, the high speed operation characteristics are improved, the volumetric efficiency is increased, and the force exerted on the movable body is better balanced.

The durability of the movable body and the rod is improved by the improved balance.

Furthermore, conventionally the intake valve and the discharge valve have different areas from each other, and generally the intake valve is larger than the discharge valve. On the other hand, in this compression machine each intake valve and the discharge valve have the same aperture area. In addition, this invention is applicable to the compression machine of either the diaphragm type or the piston type.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A compression machine comprising:

a casing having an inner wall;

a movable body mounted within said casing such that a compression chamber is formed by the movable body and the inner wall of the casing;

a single discharge valve formed in the casing and comprising means for discharging fluid from the compression chamber;

two intake valves formed in the casing and comprising means for permitting entry of fluid into the compression chamber, the two intake valves being arranged symmetrically with respect to the axial direction of the discharge valve; and a rod connected to the movable body so as to transmit reciprocal movement to the movable body;

whereby changes in the volume of the compression chamber opens or shuts the intake valves and discharge valve, wherein each of said intake valves has an aperture area equal to an aperture area of said discharge valve.

2. The compression machine of claim 1 wherein said movable body includes a plate mounted to said rod and a bellows connected between said plate and said casing.

3. The compression machine of claim 1 wherein said movable body includes a plate mounted to said rod and a bellows connected between said plate and said casing.

4. The compression machine of claim 1, wherein said discharge valve has a recessed portion into which can fit a head of said rod.

* * * * *